US011318742B2

(12) United States Patent
Xu et al.

(10) Patent No.: US 11,318,742 B2
(45) Date of Patent: May 3, 2022

(54) LIQUID DISCHARGE HEAD AND LIQUID DISCHARGE RECORDING APPARATUS

(71) Applicant: TOSHIBA TEC KABUSHIKI KAISHA, Tokyo (JP)

(72) Inventors: Li Xu, Mishima Shizuoka (JP); Ryutaro Kusunoki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/921,852

(22) Filed: Jul. 6, 2020

(65) Prior Publication Data

US 2021/0070042 A1 Mar. 11, 2021

(30) Foreign Application Priority Data

Sep. 9, 2019 (JP) ..... JP2019-163933

(51) Int. Cl.

| | |
|---|---|
| ***B41J 2/055*** | (2006.01) |
| ***B41J 2/045*** | (2006.01) |
| ***B41J 2/14*** | (2006.01) |

(52) U.S. Cl.

CPC ..... *B41J 2/055* (2013.01); *B41J 2/04588* (2013.01); *B41J 2/1433* (2013.01); *B41J 2002/14419* (2013.01); *B41J 2002/14459* (2013.01)

(58) Field of Classification Search

CPC ..... B41J 2/055; B41J 2/04588; B41J 2/1433; B41J 2002/14419; B41J 2002/14459; B41J 2002/14491; B41J 2/14201; B41J 2/01

See application file for complete search history.

(56) References Cited

U.S. PATENT DOCUMENTS

| | | | |
|---|---|---|---|
| 9,216,576 | B2 | 12/2015 | Kobayashi et al. |
| 2014/0253639 | A1 | 9/2014 | Yokoyama et al. |
| 2016/0279938 | A1 | 9/2016 | Takino et al. |
| 2018/0281402 | A1 | 10/2018 | Giusti et al. |

FOREIGN PATENT DOCUMENTS

| | | | |
|---|---|---|---|
| EP | 3372407 | A1 | 9/2018 |
| JP | 2006212781 | A | 8/2006 |
| JP | 2015-223737 | A | 12/2015 |
| WO | 2008044073 | A1 | 4/2008 |

OTHER PUBLICATIONS ip.com search (Year: 2021).*
ip.com search2 (Year: 2021).*
ip.com search3 (Year: 2021).*
Heyang Chen et al., "Room-temperature plastic inorganic semiconductors for flexible and deformable electronics", Sep. 6, 2020, Section 2: Flexibility and Plasticity (Year: 2020).*
Extended European Search Report dated Jan. 29, 2021, mailed in counterpart European Application No. 20192051.9, 10 pages.

* cited by examiner

*Primary Examiner* — Lisa Solomon
(74) *Attorney, Agent, or Firm* — Kim & Stewart LLP

(57) ABSTRACT

According to one or more embodiments, a liquid discharge head comprises a substrate, a nozzle plate, and a damper member. The substrate comprises a plurality of pressure chambers. The nozzle plate is provided on a first surface of the substrate and comprises a plurality of nozzles, each of the plurality of nozzles aligned with a corresponding one of the plurality of pressure chambers. The damper member is provided on a second surface of the substrate and comprises a pressure wave absorbing material.

20 Claims, 7 Drawing Sheets

LIQUID DISCHARGE HEAD AND LIQUID DISCHARGE RECORDING APPARATUS

CROSS-REFERENCE TO RELATED APPLICATIONS

This application is based upon and claims the benefit of priority from Japanese Patent Application No. 2019-163933, filed on Sep. 9, 2019, the entire contents of which are incorporated herein by reference.

FIELD

Embodiments described herein generally relate to a liquid discharge head and a liquid discharge recording apparatus.

BACKGROUND

A liquid discharge head used in various liquid discharge recording apparatuses, which utilizes densely-arranged nozzles to achieve reduction of head size and increase in an image resolution, is known. In such a liquid discharge head, when the volume of a pressure chamber is changed, causing liquid droplets to eject from the densely-arranged nozzles, a pressure wave is generated and propagates to other pressure chambers such as adjacent or nearby pressure chambers through a common flow path in the liquid discharge head, and the ejection of liquid droplets from the nozzles in the other pressure chambers may be affected.

Hence, there is a need for a liquid discharge head and a liquid discharge recording apparatus that is capable of suppressing the influence on other pressure chambers when a liquid droplet is ejected from a nozzle via another nearby or adjacent pressure chamber.

DETAILED DESCRIPTION

Figure 1:
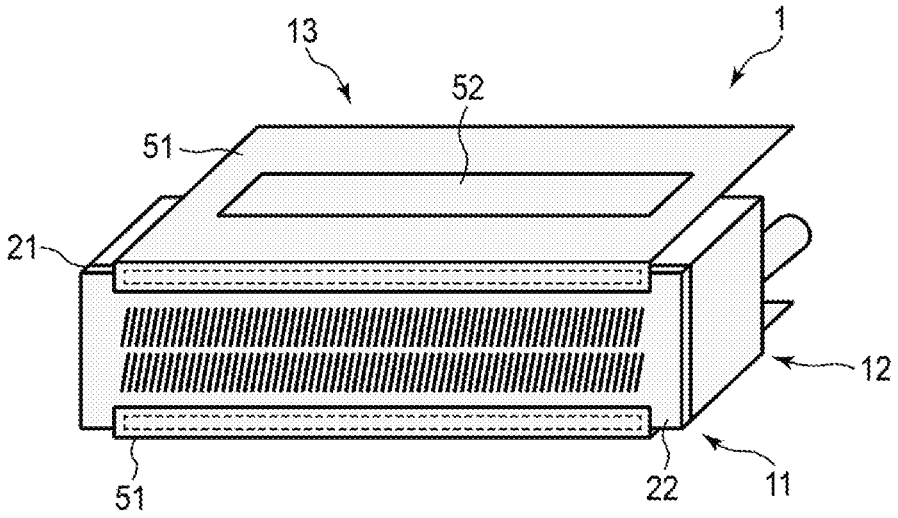
FIG. 1 depicts a liquid discharge head according to a first embodiment.

In one embodiment, a liquid discharge head comprises a substrate, a nozzle plate, and a damper member. The substrate comprises a plurality of pressure chambers. The nozzle plate is provided on a first surface of the substrate and comprises a plurality of nozzles. Each of the plurality of nozzles faces is aligned with a corresponding one of the plurality of pressure chambers. The damper member is on a second surface of the substrate and comprises a pressure wave absorbing material. Portions of the damper member are on the second surface at positions between adjacent pressure chambers generated in the pressure chamber.

First Embodiment

Hereinafter, a liquid discharge head 1 and a liquid discharge recording apparatus 100 according to a first embodiment will be described with reference to FIGS. 1 to 4. In the drawings, for the sake of description, various aspects of configuration may be shown as enlarged, reduced, or omitted as appropriate since the drawings are, in general, schematic and not intended to be to scale.

Figure 2:
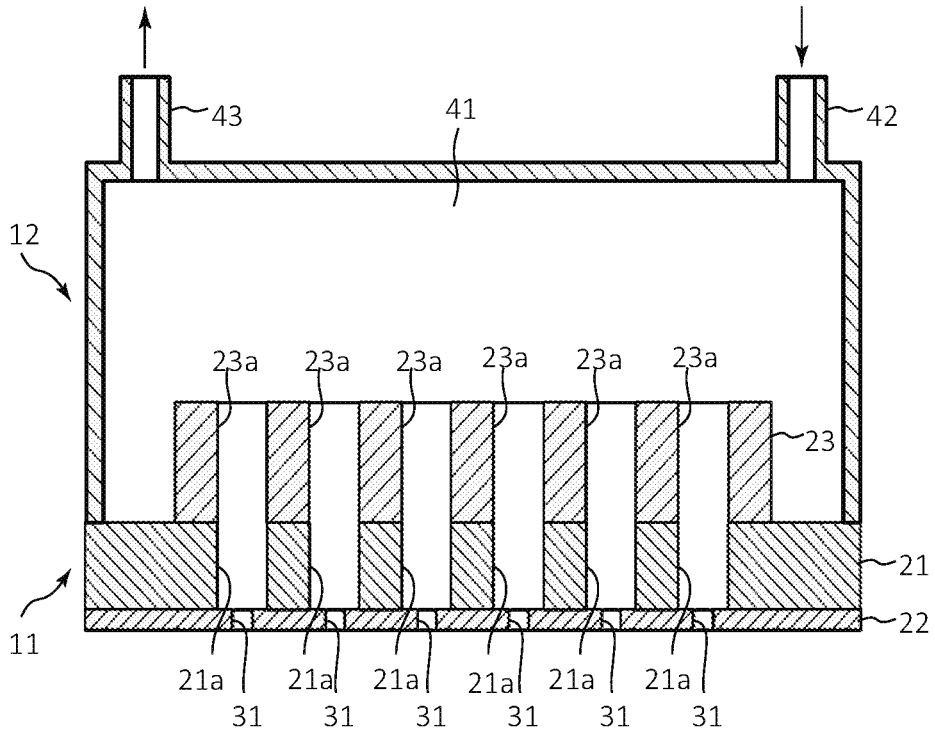
FIG. 2 depicts a configuration of a liquid discharge head in a cross-sectional view according to a first embodiment.
Figure 3:
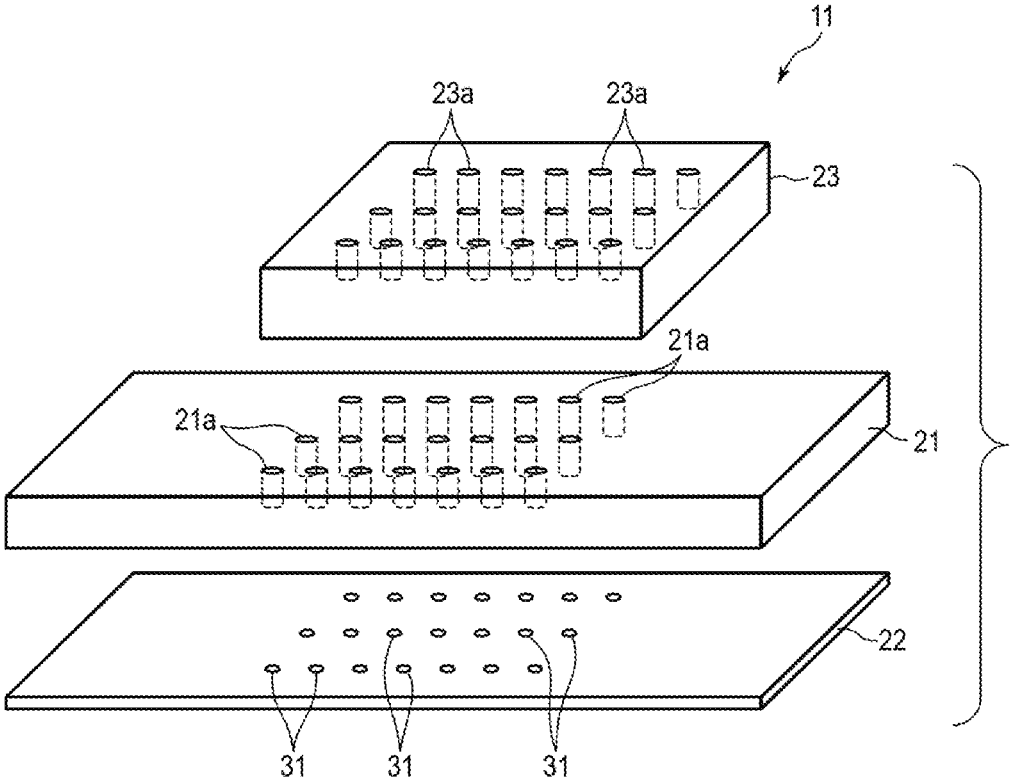
FIG. 3 depicts a configuration of a part of a liquid discharge head in a perspective view according to a first embodiment.
Figure 4:
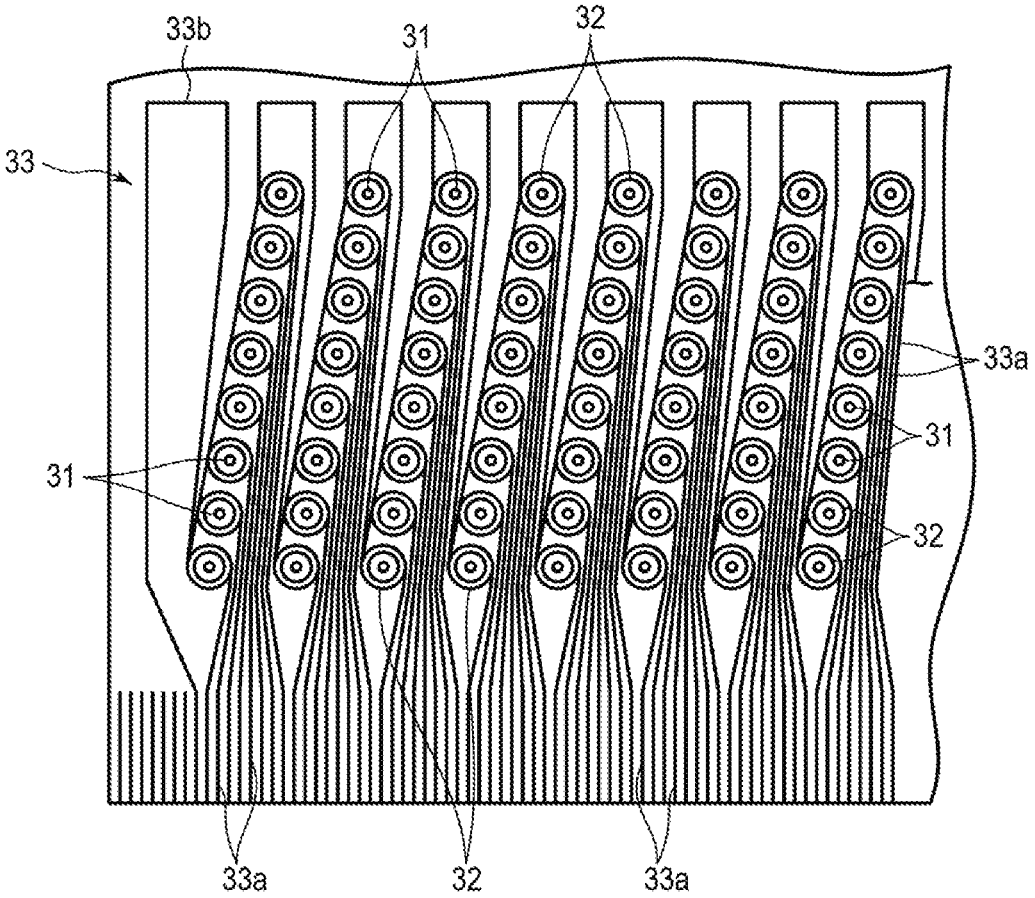
FIG. 4 depicts a configuration of a nozzle plate of a liquid discharge head in a plan view according to a first embodiment.

FIG. 1 is a perspective view illustrating a configuration of a liquid discharge head 1 according to the first embodiment. FIG. 2 is a cross-sectional view schematically illustrating the configuration of a liquid discharge unit 11 and a liquid supply unit 12 of the liquid discharge head 1, and FIG. 3 is a perspective view schematically showing the configuration of a substrate 21, a nozzle plate 22 and a damper member 23 of the liquid discharge unit 11. FIG. 4 is a plan view illustrating the configuration of the nozzle plate 22 in an enlarged manner from the outside.

Figure 5:
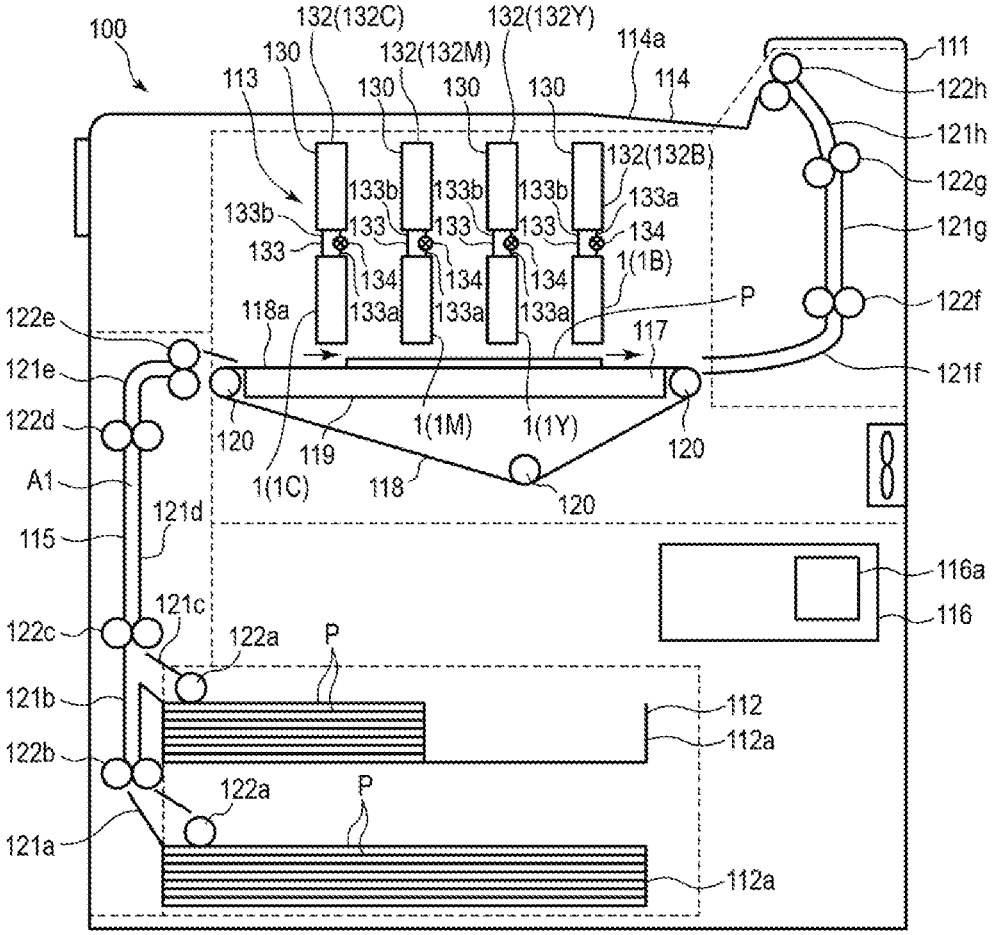
FIG. 5 depicts a configuration of a liquid discharge recording apparatus using a liquid discharge head according to a first embodiment.

As shown in FIGS. 1 and 2, the liquid discharge head 1 comprises a liquid discharge unit 11, a liquid supply unit 12, and a drive signal supply unit 13. The liquid discharge head 1 is provided, for example, in the liquid discharge recording apparatus 100 as shown in FIG. 5.

As shown in FIGS. 2 and 3, the liquid discharge unit 11 includes a substrate 21, a nozzle plate 22, and a damper member 23.

In the present embodiment, the substrate 21 is formed in a rectangular plate shape. On one main surface (hereinafter referred to as a first surface) of the substrate 21, the nozzle plate 22 is integrally fixed. On the opposite main surface (hereinafter referred to as a second surface) of the substrate 21, the liquid supply unit 12 is integrally fixed. The substrate 21 has a plurality of pressure chambers 21*a* formed therein.

Each pressure chamber 21*a* is, for example, a cylindrical through hole formed in the substrate 21. Openings of the pressure chamber 21*a* at its one end and another end are covered by the nozzle plate 22 and the liquid supply unit 12, respectively. The plurality of pressure chambers 21*a* are arranged in an array in row and column directions.

As shown in FIGS. 1 to 4, the nozzle plate 22 includes a plurality of nozzles 31, a plurality of driving elements 32, and a plurality of electrodes 33.

Each of the plurality of nozzles 31 is a through hole formed in the nozzle plate 22. Each nozzle 31 is formed, for example, in a cylindrical shape or a truncated cone shape. As shown in FIG. 4, for example, the plurality of nozzles 31 are arranged in the nozzle plate 22 in an array in a similar manner to the plurality of pressure chambers 21*a* in the row direction and the column direction. The plurality of nozzles 31 face the plurality of pressure chambers 21*a* when the nozzle plate 22 is fixed to the substrate 21. In one embodiment, the nozzle 31 is aligned coaxial with the pressure chamber 21*a*.

As shown in FIG. 4, the driving elements 32 surround each of the plurality of nozzles 31, respectively. Each driving element 32 is an actuator. The driving element 32 is, for example, formed in an annular shape. The driving element 32 is aligned, for example, coaxially with the nozzle 31.

As shown in FIG. 4, the electrodes 33 are respectively connected to the driving elements 32. Each electrode 33 includes, for example, a wiring electrode 33*a* and a shared electrode 33*b*. The wiring electrode 33*a* is used as an individual electrode to permit the driving of each driving element 32 independently.

The damper member 23 is provided on the second surface of the substrate 21. Portions of the damper member 23 are disposed on the second surface of the substrate 21 at positions between adjacent pressure chambers 21*a* and outside the outermost pressure chambers 21*a*. The damper member 23 is, for example, formed in a rectangular plate shape that is smaller in planar dimension than that of the substrate 21, as shown in FIGS. 2 and 3.

The damper member 23 is formed of an elastically deformable material. The damper member 23 is formed of a material different from that of the substrate 21. In one embodiment, the damper member 23 is formed of a material having a reflectance R of $0.5 \leq R \leq 2$ when a specific acoustic impedance of the damper member 23 is represented by Z1, a specific acoustic impedance of the liquid supplied in the pressure chamber is represented by Z2, and the reflectance $R=(Z2-Z1)/(Z1+Z2)$ is satisfied.

The damper member 23 includes, for example, a plurality of damper chambers 23*a* provided corresponding to the pressure chambers 21*a*. Each damper chamber 23*a* is, for example, a cylindrical opening having the same inner diameter as that of the pressure chamber 21*a*. The plurality of damper chambers 23*a* are arranged in the damper member 23 in an array of rows and columns in a similar manner to the plurality of pressure chambers 21*a*.

The liquid supply unit 12 covers the second surface of the substrate 21 and the damper member 23. The liquid supply unit 12 forms a common liquid chamber 41 between the second surface of the substrate 21 and the damper member 23. In addition, the liquid supply unit 12 includes a suction port 42 and a discharge port 43.

The common liquid chamber 41 forms a flow path. The common liquid chamber 41 is fluidly connected with the pressure chambers 21*a* through the damper chambers 23*a*. The suction port 42 is provided on a first side of the common liquid chamber 41. The discharge port 43 is provided on a second side of the common liquid chamber 41.

The drive signal supply unit 13 includes, for example, a flexible substrate 51 and a driver IC 52. One end of the flexible substrate 51 is connected to the wiring electrodes 33*a* and the shared electrodes 33*b*. The driver IC 52 is connected to the wiring electrodes 33*a* via, for example, the flexible substrate 51.

In the liquid discharge head 1 according to the first embodiment, portions of the damper member 23 are disposed on the second surface of the substrate 21 between adjacent pressure chambers 21*a*. When the driving element 32 is driven to cause liquid droplets to eject from a nozzle 31 corresponding to a particular pressure chamber (hereinafter referred to as a first pressure chamber) among the plurality of the pressure chambers 21*a* and a residual pressure wave in the first pressure chamber 21*a* propagates to the liquid in the damper chamber 23*a* facing the first pressure chamber 21*a* (hereinafter referred to as a first damper chamber), the damper member 23 can absorb or mitigate the propagating pressure wave. Further, the pressure wave transmitted to the common liquid chamber 41 through the first damper chamber 23*a* is attenuated in the common liquid chamber 41. In addition, the pressure wave propagated to an adjacent or nearby damper chamber 23*a* (hereinafter referred to as a second damper chamber) by crosstalk is also absorbed by the damper member 23.

Accordingly, the liquid discharge head 1 can absorb the pressure wave (or pressure waves) generated by an ejection of droplets from a nozzle (or nozzles) 31 and suppress the crosstalk by inclusion of the damper member 23, and it is thus possible to prevent the pressure wave generated when the droplets are ejected from the nozzle 31 of the first pressure chamber 21*a* from propagating to an adjacent or nearby pressure chamber 21*a*. Therefore, the liquid discharge head 1 according to the present embodiment can suppress fluctuations in the speed and volume of the liquid ejection and can eject the liquid droplets from the nozzles 31 with high accuracy.

Since the damper member 23 is formed of a material having a reflectance R of $0.5 \leq R \leq 2$ according to one embodiment, the damper member 23 can further effectively absorb the pressure waves generated in the pressure chambers 21*a*.

As described above, according to the liquid discharge head 1 of the first embodiment, the damper member 23 capable of absorbing the pressure waves is provided, and thus it is possible to suppress influences on neighboring pressure chambers 21*a* when the liquid droplets are ejected from a nozzle 31.

Next, a liquid discharge recording apparatus 100 equipped with the liquid discharge head 1 will be described with reference to FIG. 5. FIG. 5 is an explanatory diagram illustrating the configuration of an inkjet printer as one example of a liquid discharge recording apparatus 100. As shown in FIG. 5, the liquid discharge recording apparatus 100 includes a housing 111, a recording medium supply unit 112, an image forming unit 113, a recording medium ejection unit 114, a conveyance device 115, and a controller 116.

The liquid discharge recording apparatus 100 is an ink jet printer that performs an image forming process on a sheet of paper P by discharging a liquid, such as ink, while moving the sheet of paper P, along a predetermined conveyance path A1 extending from the recording medium supply unit 112 through the image forming unit 113 to the recording medium ejection unit 114. In this context, the sheet of paper P can be referred to as a recording medium. In other examples, the recording medium may, in general, be any object on to which an image or information can be transferred via image forming unit 113.

The recording medium supply unit 112 comprises a plurality of sheet feeding cassettes 112*a*. The recording medium ejection unit 114 includes an ejection tray 114*a*. The image forming unit 113 comprises a support portion 117 that supports sheets and a plurality of head units 130 disposed above the support portions 117.

The support portion 117 includes a conveyance belt 118 provided in a loop shape and there is a predetermined region/position utilized for forming an image, a support plate 119 configured to support the conveyance belt 118 from the back side, and a plurality of belt rollers 120 provided on the back side of the conveyance belt 118.

The head unit 130 comprises: a plurality of liquid discharge heads 1; a plurality of supply tanks 132, which are liquid tanks mounted on each liquid discharge head 1, a plurality of connection flow paths 133, each configured to connect a corresponding one of the liquid discharge heads 1 with a corresponding one of the supply tanks 132; and a plurality of circulation pumps 134, each configured to serve as a circulation unit. The head unit 130 in this example is a circulating head unit type through which circulates liquid ink.

In the present embodiment, liquid discharge heads 1C, 1M, 1Y, and 1K, respectively for cyan, magenta, yellow, and black, are provided as the liquid discharge heads 1 and supply tanks 132C, 132M, 132Y, and 132K are respectively provided for containing the inks of the respective colors. These supply tanks 132 are connected to the liquid discharge heads 1 by the corresponding connection flow paths 133. Each connection flow path 133 includes a supply flow path 133*a* connected to the suction port 42 of the liquid discharge head 1 and a collection flow path 133*b* connected to the discharge port 43 of the liquid discharge head 1.

A negative pressure control device such as a pump is also connected to the supply tank 132 according to one embodiment. The ink supplied to each nozzle of a liquid discharge head 1 is formed into a meniscus having a predetermined shape by controlling the negative pressure in the supply tank 132 with the negative pressure control device according to the hydrostatic head value of the liquid discharge head 1 and the supply tank 132.

Each circulation pump 134 is, for example, a liquid feeding pump configured by a piezoelectric pump. The circulation pump 134 is provided in the supply flow path 133*a*. The circulation pump 134 is connected to the controller 116 by a wire. The circulation pump 134 is controlled by the controller 116. The circulation pump 134 circulates the liquid in a circulation flow path including the liquid discharge head 1 and the supply tank 132.

The conveyance device 115 conveys a sheet of paper P along the conveyance path A1 extending from the sheet feeding cassette 112*a* of the recording medium supply unit 112 through the image forming unit 113 to the media ejection tray 114*a* of the recording medium discharge unit 114. The conveyance device 115 includes a plurality of guide plate pairs 121*a* to 121*h* disposed along the conveyance path A1 and a plurality of conveyance rollers 122*a* to 122*h*. The conveyance device 115 supports the sheet of paper P to be movable relative to the liquid discharge head 1. That is, the conveyance device 115 moves the sheet of paper P past the liquid discharge head 1 during printing of the like.

The controller 116 includes a central processing unit (CPU) 116*a* as an example of a processor, a read only memory (ROM) that stores various programs and the like, a random access memory (RAM) that temporarily stores various types of variable data and image data, and an interface that receives data from the outside and outputs data to the outside. The processor performs various operations on data or the like based on programs stored in the memory. By executing a program stored in the memory, the processor functions as a control unit or controller that is capable of executing various operations according to program instructions.

In the liquid discharge recording apparatus 100 equipped with the liquid discharge head 1 according to the present embodiment, during the operation of the liquid discharge from the nozzle (or nozzles) 31 (hereinafter also referred to as a target nozzle), the controller 116 applies a driving voltage to the driving element 32 corresponding to the target nozzle 31 by the driver IC 52. For example, the controller 116 drives the driving element 32, deforms the periphery of the target nozzle 31 in a direction in which the volume of the pressure chamber 21*a* aligned with the target nozzle 31 increases, and causes the pressure chamber 21*a* to have a negative pressure, thereby guiding the ink into the pressure chamber 21*a*. Subsequently, the controller 116 drives the driving element 32, deforms the periphery of the target nozzle 31 in a direction in which the volume of the pressure chamber 21*a* increases, and pressurizes the inside of the pressure chamber 21*a*, thereby ejecting the droplets from the target nozzle 31.

By using the liquid discharge head 1 equipped with the damper member 23, the liquid discharge recording apparatus 100 according to the present embodiment can suppress fluctuations in the speed and volume of the liquid ejection from the nozzles 31 and can eject the liquid droplets with high accuracy. Thus, the liquid discharge recording apparatus 100 is capable of printing on a sheet of paper P with high accuracy.

Second Embodiment

Figure 6:
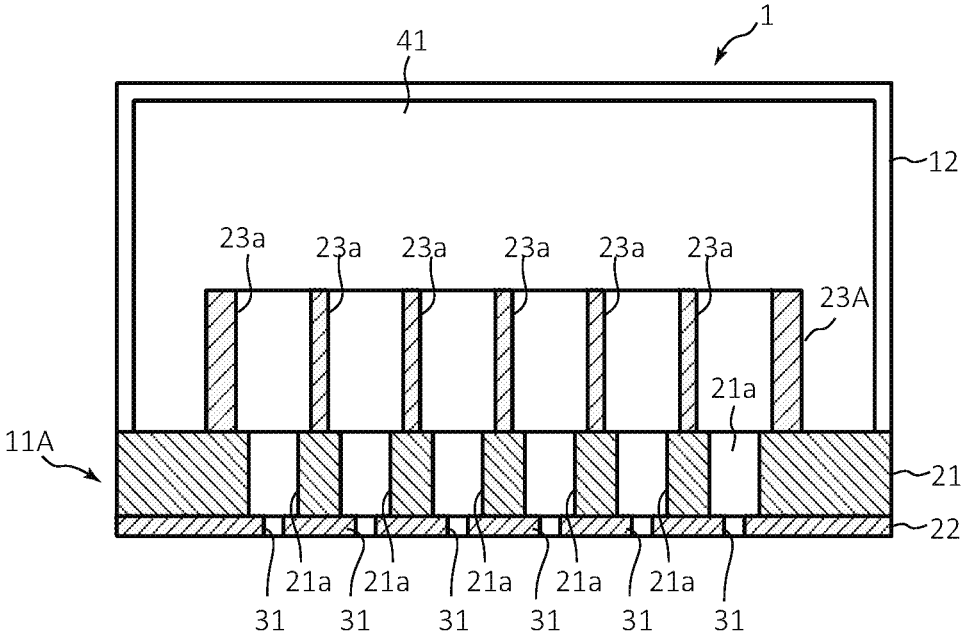
FIG. 6 depicts a configuration of a liquid discharge head in a cross-sectional view according to a second embodiment.

Next, a liquid discharge head 1 according to a second embodiment will be described with reference to FIG. 6. FIG. 6 is a cross-sectional view illustrating a configuration of the liquid discharge head 1 according to the second embodiment. In the liquid discharge head 1 according to the second embodiment, the same components as those of the liquid discharge head 1 according to the first embodiment are denoted by the same reference numerals, and detailed description thereof will be omitted. In FIG. 6, for the sake of description, certain aspects of the configuration may be enlarged, reduced, or omitted.

The liquid discharge head 1 according to the second embodiment includes a liquid discharge unit 11A, a liquid supply unit 12, and a drive signal supply unit 13 (see FIG. 1). As shown in FIG. 6, the liquid discharge unit 11A includes a substrate 21, a nozzle plate 22, and a damper member 23A.

Portions of the damper member 23A are provided on the second surface of the substrate 21 at positions between adjacent pressure chambers 21*a*. The damper member 23A is formed in a rectangular plate shape having a planar dimension smaller than the substrate 21, as shown in FIG. 6, for example. The damper member 23A includes a plurality of damper chambers 23*a* provided facing, at one end thereof, the corresponding pressure chambers 21*a*. Each damper chamber 23*a* is, for example, a cylindrical opening with an inner diameter that is larger than that of the pressure chamber 21*a*. The damper member 23A is formed of the same material as that of the damper member 23 according to the first embodiment.

In the liquid discharge head 1 having the liquid discharge unit 11A according to the second embodiment, as with the liquid discharge head 1 according to the first embodiment, by integrating therein the damper member 23A capable of absorbing a pressure wave, it is possible to suppress influences on neighboring or nearby pressure chambers 21*a* when the liquid droplets are ejected from one or more first nozzles 31. Each damper chamber 23*a* is an opening with a diameter larger than that of the pressure chamber 21*a*. The damper chamber 23*a* of this configuration prevents the obstruction of a smooth liquid flow from the common liquid chamber 41 to the pressure chamber 21*a*.

Third Embodiment

Figure 7:
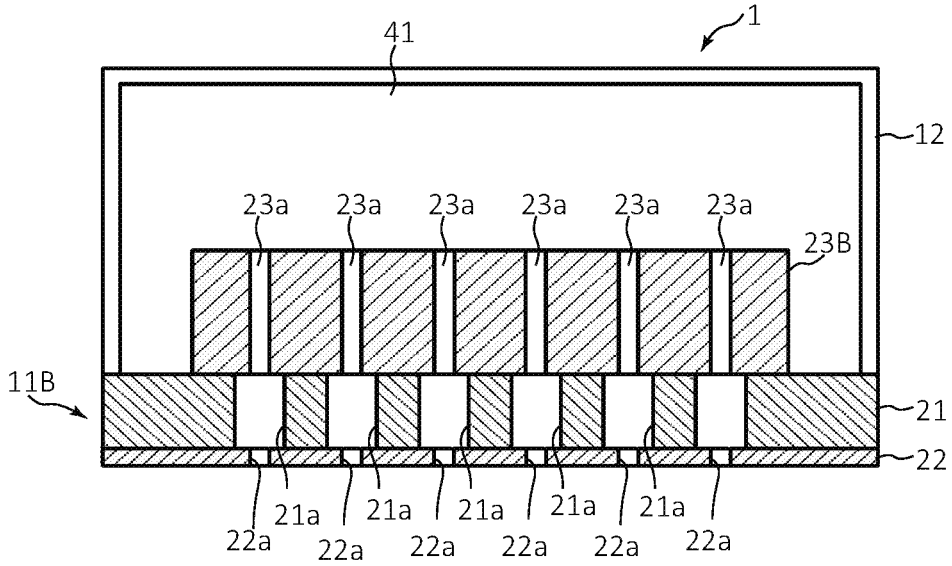
FIG. 7 depicts a configuration of a liquid discharge head in a cross-sectional view according to a third embodiment.

Next, a liquid discharge head 1 according to a third embodiment will be described with reference to FIG. 7. FIG. 7 is a cross-sectional view illustrating a configuration of the liquid discharge head 1 according to the third embodiment. In the liquid discharge head 1 according to the third embodiment, the same components as those of the liquid discharge head 1 according to the first embodiment are denoted by the same reference numerals, and detailed description thereof will be omitted. FIG. 7, for the sake of description, certain aspects of the configuration may be enlarged, reduced, or omitted.

The liquid discharge head 1 according to the third embodiment includes a liquid discharge unit 11B, a liquid supply unit 12, and a drive signal supply unit 13 (see FIG. 1). As shown in FIG. 7, the liquid discharge unit 11B includes a substrate 21, a nozzle plate 22, and a damper member 23B.

Portions of the damper member 23B are provided on the second surface of the substrate 21 at positions between adjacent pressure chambers 21*a*. The damper member 23B is formed in a rectangular plate shape having a planar dimension smaller than that of the substrate 21, as shown in FIG. 7, for example. The damper member 23B includes a plurality of damper chambers 23*a* provided to face the corresponding pressure chambers 21*a*. Each damper chamber 23*a* is, for example, a cylindrical opening with an inner diameter smaller than that of the pressure chamber 21*a*. The damper member 23B is formed of the same material as that of the damper member 23 according to the first embodiment.

In the liquid discharge head 1 having the liquid discharge unit 11B according to the third embodiment, as with the liquid discharge head 1 according to the first embodiment, by integrating therein the damper member 23B capable of absorbing a pressure wave, it is possible to suppress influences on neighboring or nearby pressure chambers 21*a* when the liquid droplets are ejected from one or more first nozzles 31. Further, since each damper chamber 23*a* of the damper member 23B is an opening with a smaller diameter than that of the pressure chamber 21*a*, the thickness of the damper member 23B between the adjacent pressure chambers 21*a* is larger than that of damper member 23 in the first embodiment. Therefore, the liquid discharge head 1 can further absorb the pressure wave by the damper member 23B as compared with the first embodiment.

Fourth Embodiment

Figure 8:
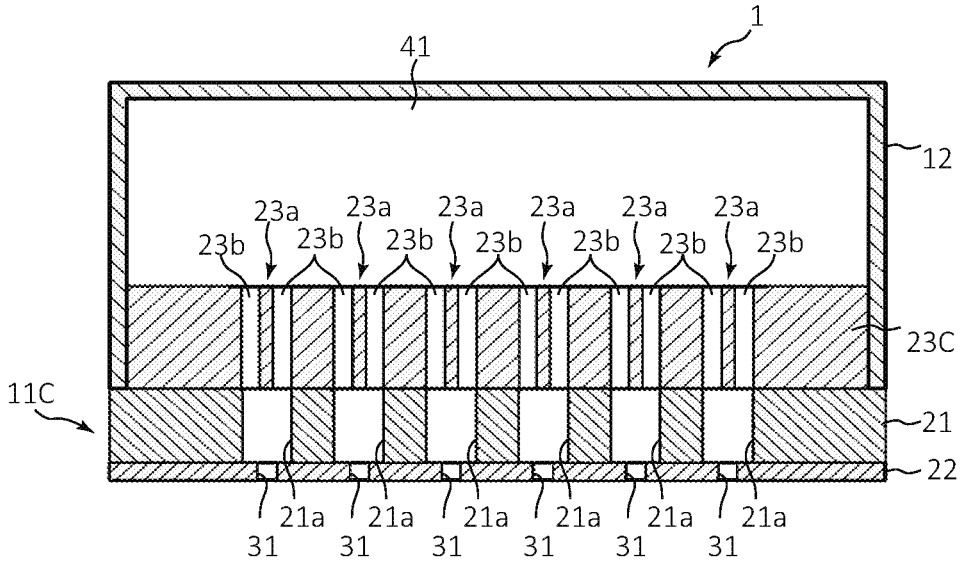
FIG. 8 depicts a configuration of a liquid discharge head in a cross-sectional view according to a fourth embodiment.

Next, a liquid discharge head 1 according to a fourth embodiment will be described with reference to FIG. 8. FIG. 8 is a cross-sectional view illustrating a configuration of the liquid discharge head 1 according to the fourth embodiment. In the liquid discharge head 1 according to the fourth embodiment, the same components as those of the liquid discharge head 1 according to the first embodiment are denoted by the same reference numerals, and detailed description thereof will be omitted. FIG. 8, for the sake of description, certain aspects of the configuration may be enlarged, reduced, or omitted.

The liquid discharge head 1 according to the fourth embodiment includes a liquid discharge unit 11C, a liquid supply unit 12, and a drive signal supply unit 13 (see FIG. 1). As shown in FIG. 8, the liquid discharge unit 11C includes a substrate 21, a nozzle plate 22, and a damper member 23C.

Portions of the damper member 23C are provided on the second surface of the substrate 21 at positions between adjacent pressure chambers 21*a*. The damper member 23C is, for example, formed in a rectangular plate shape having a planar dimension that is smaller than the substrate 21. In this example, the damper member 23C has the same size as the opening area of the common liquid chamber 41, as shown in FIG. 8. The damper member 23C includes a plurality of damper chambers 23*a* provided so as to face the corresponding pressure chambers 21*a*. Each of the plurality of damper chamber 23*a* has, for example, a plurality of through holes 23*b*, each having a cylindrical shape with a flow diameter smaller than that of the pressure chamber 23*a*. That is, each damper chamber 23*a* is formed by a set of the plurality of through holes 23*b* disposed facing an open end of one pressure chamber 21*a* corresponding to that damper chamber 23*a*. Note that the damper member 23C is formed of the same material as that of the damper member 23 according to the first embodiment.

In a similar manner to the liquid discharge head 1 according to the first embodiment, the liquid discharge head 1 having the liquid discharge unit 11C equipped with the damper member 23C capable of absorbing the pressure wave according to the fourth embodiment, can suppress influences of the liquid droplet ejection from the nozzles 31 on the pressure chambers 21*a*.

Further, since each of the damper chambers 23*a* of the damper member 23C is constituted by the plurality of through holes 23*b* that each have a smaller diameter than that of the corresponding pressure chamber 21*a*, the damper member 23B can further absorb the pressure waves as compared with the first embodiment. Also, since each damper chamber 23*a* includes several through holes 23*b*, the opening area of the damper chamber 23*a* can still be provided as much as possible, and restriction, if any, of the liquid flow from the common liquid chamber 41 into the pressure chamber 21*a* can be limited.

In the present embodiment, the damper member 23C may be formed to have the same size as the size of the common liquid chamber 41 in the flow direction of the liquid, that is, the same size as the opening area of the opening along the liquid flow direction in the common liquid chamber 41. This configuration can prevent undesirable steps from being formed in the flow direction of the common liquid chamber 41. Therefore, the damper member 23C can suppress disturbance of the flow in the common liquid chamber 41. Note that the configuration in which the damper member is formed to have the same size as that of the common liquid chamber 41 in the liquid flow direction may be applied to other embodiments.

Fifth Embodiment

Figure 9:
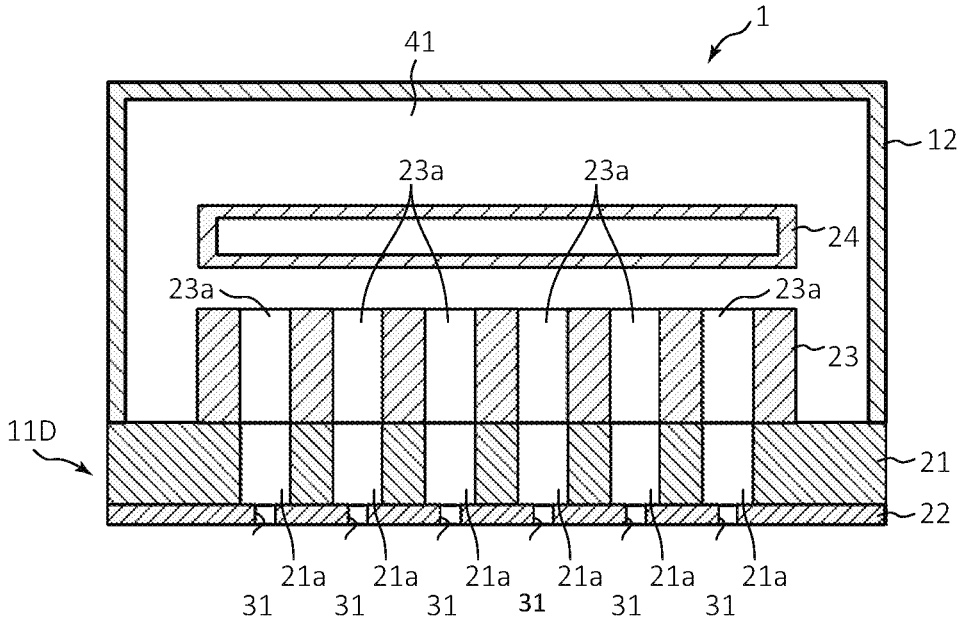
FIG. 9 depicts a configuration of a liquid discharge head in a cross-sectional view according to a fifth embodiment.

Next, a liquid discharge head 1 according to a fifth embodiment will be described with reference to FIG. 9. FIG. 9 is a cross-sectional view illustrating a configuration of the liquid discharge head 1 according to the fifth embodiment. In the liquid discharge head 1 according to the fifth embodiment, the same components as those of the liquid discharge head 1 according to the first embodiment are denoted by the same reference numerals, and detailed description thereof will be omitted. In FIG. 9, for the sake of description, certain aspects of the configuration may be enlarged, reduced, or omitted.

The liquid discharge head 1 according to the fifth embodiment includes a liquid discharge unit 11D, a liquid supply unit 12, and a drive signal supply unit 13 (see FIG. 1). As shown in FIG. 9, the liquid discharge unit 11D includes a substrate 21, a nozzle plate 22, a first damper member 23, and a second damper member 24.

The first damper member 23 has the same configuration as that of the damper member 23 of the liquid discharge unit 11 according to the first embodiment, for example.

The second damper member 24 is provided in the common liquid chamber 41. The second damper member 24 has a main surface facing towards the plurality of pressure chambers 21*a* and the plurality of damper chambers 23*a*. The second damper member 24 is, for example, hollow and is formed in a film-like material that is elastically deformable or at least has flexibility in a portion facing towards the damper member 23. The second damper member 24 is formed of, for example, the same material as that of the first damper member 23.

According to the liquid discharge head 1 having the liquid discharge unit 11D according to the fifth embodiment, similarly to the liquid discharge head 1 according to the first embodiment, the absorption of the pressure wave generated by the ejection of the droplets and the suppression of the crosstalk can be performed by the first damper member 23, and the pressure wave generated when the liquid droplets are discharged from the nozzles 31 can be suppressed from propagating to adjacent pressure chambers 21*a*.

In addition, the pressure waves propagated from the damper chambers 23*a* to the common liquid chamber 41 are absorbed by the second damper member 24. Therefore, the pressure waves transmitted to the common liquid chamber 41 through the damper chambers 23*a* are attenuated by the second damper member 24. Accordingly, the propagation of the pressure waves generated in the pressure chambers 21*a* to the adjacent or nearby damper chambers 23*a* and pressure chambers 21*a* by the crosstalk can be effectively suppressed. Note that the second damper member 24 may be applied in combination with the other embodiments (first embodiment through fourth embodiment).

Sixth Embodiment

Figure 10:
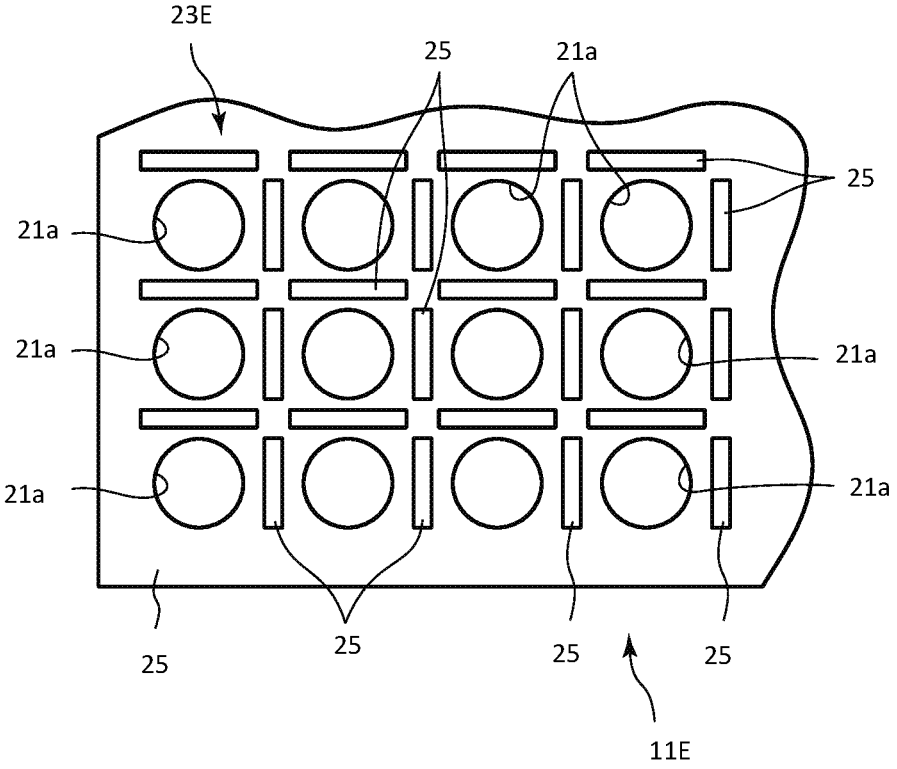
FIG. 10 depicts a configuration of a part of a liquid discharge head in a plan view according to a sixth embodiment.

Next, a liquid discharge head 1 according to a sixth embodiment will be described with reference to FIG. 10. FIG. 10 is a plan view illustrating a configuration of the liquid discharge head 1 according to the sixth embodiment. In the liquid discharge head 1 according to the sixth embodiment, the same components as those of the liquid discharge head 1 according to the first embodiment are denoted by the same reference numerals, and detailed description thereof will be omitted. In FIG. 10, for the sake of description, certain aspects of the configuration may be enlarged, reduced, or omitted.

The liquid discharge head 1 according to the sixth embodiment includes a liquid discharge unit 11E, a liquid supply unit 12, and a drive signal supply unit 13 (see FIG. 1). As shown in FIG. 10, the liquid discharge unit 11E includes a substrate 21, a nozzle plate 22, and a damper member 23E constituted by a plurality of damper walls 25.

The damper walls 25 are provided on the second surface of the substrate 21. As shown in FIG. 10, each damper wall 25 is disposed between adjacent pressure chambers 21*a*. Each damper wall 25 partitions the adjacent pressure chambers 21*a*. The adjacent damper walls 25 are spaced apart from each other. Each of the damper walls 25 is, for example, a wall having a rectangular plate shape.

The damper wall 25 is formed of a material that can be elastically deformed. The damper wall 25 is formed of a material different from that of the substrate 21. As a specific example, the damper wall 25 is formed of a material having a reflectance R of $0.5 \leq R \leq 2$ when the specific acoustic impedance is represented by Z1, the specific acoustic impedance of the liquid supplied into the pressure chamber is represented by Z2, and the reflectance R is represented by $(Z2-Z1)/(Z1+Z2)$.

In the liquid discharge head 1 according to the sixth embodiment as described above, the discrete damper walls 25 are provided between the adjacent pressure chambers 21*a* rather than a damper member 23. Therefore, the liquid discharge head 1 can absorb the pressure wave generated by the jet of droplets and suppress the crosstalk. The damper walls 25 are partitions positioned between adjacent pressure chambers 21*a*. Furthermore, the adjacent damper walls 25 are spaced apart from each other. Therefore, while the damper walls 25 are positioned to limit crosstalk, they do not substantially inhibit the flow of the liquid from the common liquid chamber 41 into the pressure chamber 21*a*.

In the embodiments described above, each of the damper members 23, 23A, 23B, 23C, 23D, 23E, and 24 is formed of a material having a reflectance R of $0.5 \leq R \leq 2$; however, the present disclosure is not limited to these embodiments. For example, the damper members 23, 23A, 23B, 23C, 23D, 23E, and 24 may be formed of material having a Young's modulus less than that of the substrate 21. Furthermore, the damper members 23, 23A, 23B, 23C, 23D, 23E, and 24 may be formed of a material having a Young's modulus less than that of the substrate 21 and having a reflectance R of $0.5 \leq R \leq 2$, for example.

The liquid to be ejected is not limited to the ink for printing. For example, a device for ejecting a liquid containing conductive particles for forming a wiring pattern of a printed wiring board may be applicable.

While in the embodiments described above, the liquid discharge head is applied to a liquid discharge recording apparatus, such as an inkjet recording apparatus, its application is not limited thereto. For example, the liquid discharge head can be used for a 3D printer, an industrial manufacturing machine, a medical device application, and the like, and it is still possible to obtain the advantages of the example embodiments, such as improvements in printing quality and/or a reduction in size, weight, or cost of such other apparatus types.

According to the liquid discharge head or the liquid discharge recording apparatus of the embodiments described above, influences of the droplet ejection from the nozzles on neighboring or nearby pressure chambers can be effectively suppressed.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A liquid discharge head, comprising:

a substrate comprising a plurality of pressure chambers;

a nozzle plate on a first surface of the substrate and comprising a plurality of nozzles, each of the plurality of nozzles aligned with a corresponding one of the plurality of pressure chambers; and a damper member on a second surface of the substrate and comprising a pressure wave absorbing material, portions of the damper member being on the second surface at positions between adjacent pressure chambers, wherein the pressure wave absorbing material of the damper member has a Young's modulus less than that of a material forming the substrate.

2. The liquid discharge head according to claim 1, wherein the damper member comprises a plurality of damper chambers respectively facing the plurality of pressure chambers.

3. The liquid discharge head according to claim 1, wherein the pressure wave absorbing material is an elastically deformable material.

4. The liquid discharge head according to claim 1, wherein the damper member includes a damper chamber facing one of the pressure chambers, and the damper chamber is a cylindrical opening in the damper member having an inner diameter that is greater than a diameter of the one of the pressure chambers.

5. The liquid discharge head according to claim 1, wherein the damper member includes a damper chamber facing one of the pressure chambers, and the damper chamber is a cylindrical opening in the damper member having an inner diameter that is less than a diameter of the one of the pressure chambers.

6. The liquid discharge head according to claim 1, wherein the damper member includes a damper chamber facing one of the pressure chambers, and the damper chamber comprises a plurality of through holes in the damper member, each through hole having an inner diameter that is less than a diameter of the one of the pressure chambers.

7. The liquid discharge head according to claim 1, further comprising:

a second damper member spaced from the damper member in a common pressure chamber, the second damper member comprising a pressure wave absorbing material.

8. The liquid discharge head according to claim 1, wherein the portions of the damper member are damper walls spaced from each other in a direction parallel to the second surface.

9. The liquid discharge head according to claim 1, wherein the damper member includes a damper chamber facing one of the pressure chambers, and the damper chamber is a cylindrical opening in the damper member having an inner diameter that is substantially equal to a diameter of the one of the pressure chambers.

10. The liquid discharge head according to claim 1, wherein the pressure wave absorbing material has a reflectance R of $0.5 \leq R \leq 2$ when a specific acoustic impedance of the damping member is represented by Z1, a specific acoustic impedance of the liquid supplied in the pressure chamber is represented by Z2, and the reflectance R is calculated as $(Z2-Z1)/(Z1+Z2)$.

11. A liquid discharge head, comprising:

a liquid supply unit; and a liquid discharge unit including:

a substrate with a plurality of pressure chambers therein, a nozzle plate on a first surface of the substrate and including a plurality of nozzles, and a damper member on a second surface of the substrate at positions between the plurality of pressure chamber and formed of an elastically deformable material, wherein the liquid supply unit covers the second surface of the substrate and the damper member and forms a common liquid chamber that is fluidly connected to the plurality of nozzles, and the elastically deformable material of the damper member has a Young's modulus less than that of a material forming the substrate.

12. The liquid discharge head according to claim 11, wherein the damper member is configured to absorb pressure waves generated in the plurality of pressure chambers by the ejection of liquid from the plurality of nozzles.

13. The liquid discharge head according to claim 11, wherein the elastically deformable material has a reflectance R of $0.5 \leq R \leq 2$ when a specific acoustic impedance of the damping member is represented by Z1, a specific acoustic impedance of the liquid supplied in the pressure chamber is represented by Z2, and the reflectance R is calculated as $(Z2-Z1)/(Z1+Z2)$.

14. The liquid discharge head according to claim 11, wherein the nozzle plate further comprises a plurality of driving elements configured to drive the ejection of liquid from the plurality of nozzles.

15. The liquid discharge head according to claim 11, wherein nozzles of the plurality of nozzles are each coaxial with a corresponding one of the plurality of the pressure chambers.

16. A liquid discharge recording apparatus, comprising:

a liquid discharge head that includes:

a substrate having a plurality of pressure chambers, a nozzle plate on a first surface of the substrate and including a plurality of nozzles facing the plurality of pressure chambers, and a damper member on a second surface of the substrate, the damper member being elastically deformable material; and a media support device configured to position an object relative to the liquid discharge head for liquid droplet discharge.

17. The liquid discharge recording apparatus according to claim 16, wherein the damper member is elastically deformable with a pressure variation caused by liquid droplet discharge.

18. The liquid discharge recording apparatus according to claim 16, wherein the elastically deformable material of the damper member has a Young's modulus less than that of a material forming the substrate.

19. The liquid discharge recording apparatus according to claim 16, wherein the elastically deformable material of the damper member has a reflectance R of $0.5 \leq R \leq 2$ when a specific acoustic impedance of the damping member is represented by Z1, a specific acoustic impedance of the liquid supplied in the pressure chamber is represented by Z2, and the reflectance R is calculated as $(Z2-Z1)/(Z1+Z2)$.

20. The liquid discharge recording apparatus according to claim 16, wherein nozzles of the plurality of nozzles are each coaxial with a corresponding one of the plurality of the pressure chambers.

* * * * *